United States Patent [19]

Malott

[11] 4,123,968

[45] Nov. 7, 1978

[54] POWER VENT

[75] Inventor: Richard C. Malott, Spring Lake, Mich.

[73] Assignee: Leigh Products, Inc., Coopersville, Mich.

[21] Appl. No.: 788,281

[22] Filed: Apr. 18, 1977

[51] Int. Cl.[2] ..... F24F 7/02

[52] U.S. Cl. ..... 98/43 R; 248/18; 248/221.3; 248/303; 417/363

[58] Field of Search ..... 98/43, 43 R; 248/17, 248/18, 14, 3, 15, 302; 220/95; 29/453; 417/363

[56] References Cited

U.S. PATENT DOCUMENTS

| | | | |
|---|---|---|---|
| 2,512,159 | 6/1950 | Koch | 248/14 X |
| 2,903,209 | 9/1959 | Strub | 248/15 |
| 2,923,580 | 2/1960 | Dwyer | 29/453 X |
| 2,936,837 | 3/1960 | Coe | 230/117 |
| 3,759,158 | 9/1973 | Henry et al. | 98/33 |
| 3,773,285 | 11/1973 | Morrill | 248/15 |
| 3,934,494 | 1/1976 | Butler | 98/43 |

*Primary Examiner*—William E. Wayner
*Assistant Examiner*—William E. Tapolcai, Jr.
*Attorney, Agent, or Firm*—Price, Heneveld, Huizenga & Cooper

[57] ABSTRACT

A power vent is disclosed including a housing assembly having a base and a cylindrical, open ended shroud joined to the base and within which is supported a fan assembly. A wire frame is molded into the inner peripheral surface of the shroud to reinforce the shroud and also provide a bracket for supporting the motor of the fan assembly. A molded plastic hood including hood support brackets is securable to the shroud so that the assembly may be employed as a roof vent. In another embodiment, the base of the housing may be shaped to receive a louver assembly and the assembly may be used as a gable end vent.

19 Claims, 10 Drawing Figures

POWER VENT

BACKGROUND OF THE INVENTION

This invention relates to a ventilation apparatus and more particularly to a power vent for ventilating an attic space or the like.

Various forms of ventilation systems have been proposed for removing warm air from an attic space or the like during warm weather to reduce air conditioning loads. These systems are also used to remove insulation damaging moisture from the ventilated spaced during the winter months. Prior proposals have taken the form of either a natural ventilation system or a power ventilation system. With either system, a plurality of under eaves vents are provided. Natural systems include hooded roof vents mounted in apertures formed in the roof or a continuous, roof ridge vent mounted at the ridge or peak of the roof.

In order to increase the amount of air removed from such spaces, to supplement existing systems, to further decrease air conditioning loads or to ventilate other areas which may contain noxious fumes, power ventilators or power vents are employed. These vents are either mounted on the roof adjacent the peak or roof ridge of the roof at apertures formed therein or are mounted at the gable end of the roof structure. Typically, either of these two types of power vents include some form of mounting flange or base and a tubular shroud or duct within which is disposed a fan assembly. The duct is mounted at either an opening in the roof or at the gable end of the roof behind a louver assembly.

Various attempts have been made to develop power vents which are sufficiently durable to withstand exposure to the elements including wind, rain, snow, heat, cold and sunlight yet still be capable of moving sufficient air from the ventilated space and with minimum noise. Reliability is a critical factor since these structures are mounted in relatively inaccessible or hard to reach areas such as on the roof of the home or building or within an attic space.

Examples of some prior ventilators of the general type under consideration may be found in U.S. Pat. Nos. 2,926,837, entitled POWER ROOF VENTILATOR and issued Mar. 1, 1960 to Robert D. Coe; 2,987,983, entitled PLASTIC CASING FOR AIR EXHAUSTER and issued June 13, 1961 to I. I. Solzman; 3,302,551, entitled VENTILATOR and issued Feb. 7, 1967 to P. D. Van Belle; and 3,934,494, entitled POWER VENTILATOR and issued Jan. 27, 1976 to Henry N. Butler.

The aforementioned U.S. Pat. No. 3,934,494 discloses a power ventilator which is fabricated from a plastic material such as polyethylene. The ventilator includes a housing assembly which is heat-shrunk onto a wire frame assembly. The wire frame is provided to reinforce the polyethylene material. Another fairly complex multi-piece frame assembly is employed to support a hood above the housing assembly and to secure the housing assembly to the roof of a building. Further, the motor of the fan assembly includes flanges to secure the motor to a plurality of motor mount brackets defined by the hood support frame assembly.

SUMMARY OF THE INVENTION

In accordance with the present invention a unique power ventilator is provided whereby noise is reduced, a stable, reliable and rigid structure is provided capable of withstanding the forces imposed upon it during use and which is also relatively easy to manufacture and assemble when compared with prior art approaches. Essentially, the power vent includes a housing assembly having a tubular, open ended member defining an air duct within which a fan may be disposed. A rigid, wire frame defines a fan and motor mount and also includes a plurality of open ended member, reinforcing portions. Means formed as part of the open ended member are provided for receiving the reinforcing portions of the frame and for supporting the frame within the air duct.

In narrower aspects of the invention, the wire frame may be secured to the housing by molding the housing around the wire frame during fabrication. The tubular open ended member may include a mounting flange adapting it for mounting on the roof of a building and the like. A hood including a pair of hood support brackets may be attached to the open ended tubular member above the air duct. In the alternative, the tubular open ended member may be provided with a base defining a recess within which a louver assembly may be positioned.

DETAILED DESCRIPTION OF THE PREFERRED EMBODIMENTS

Figure 1:
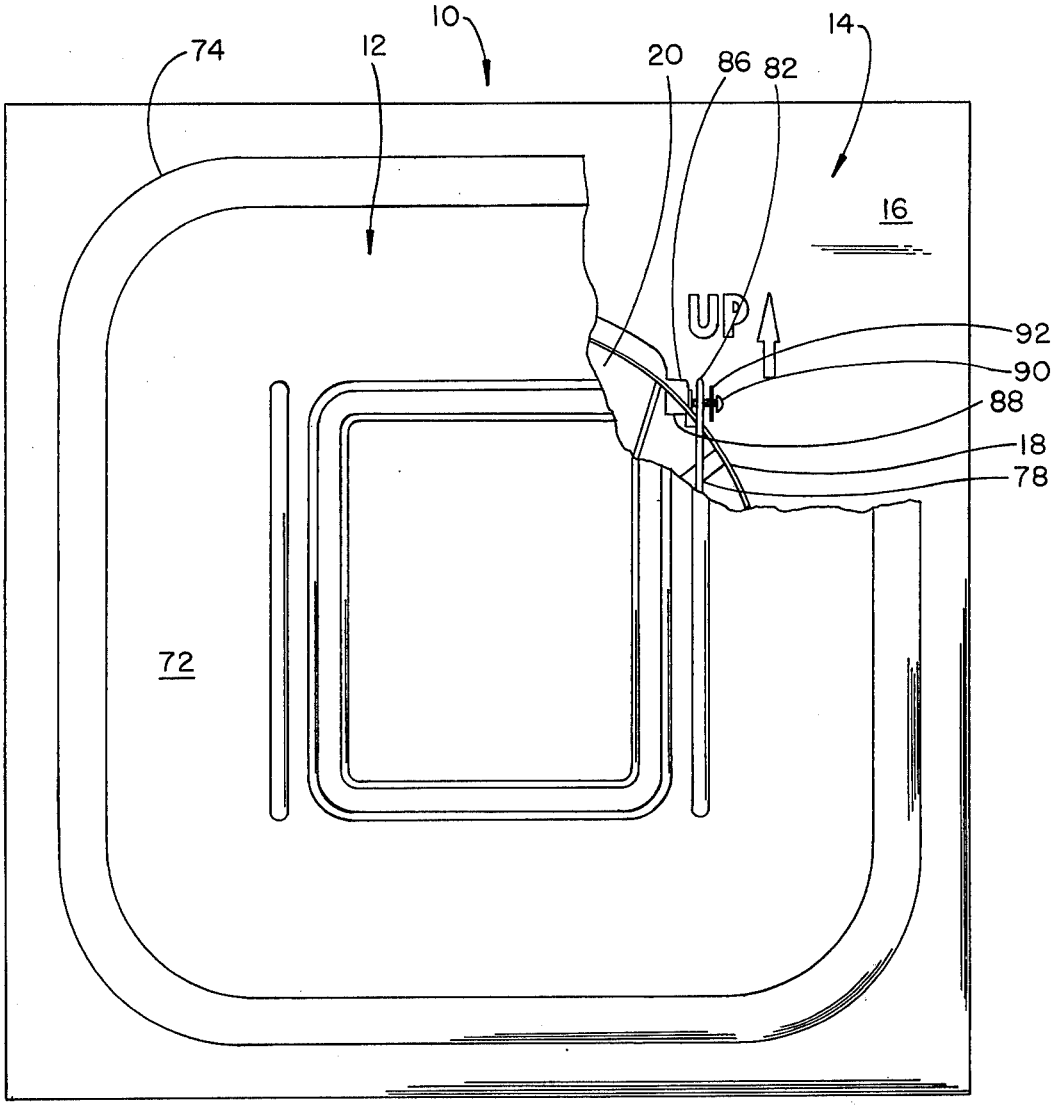
FIG. 1 is a partially fragmented, top plan view of one embodiment of the power vent in accordance with the present invention.
Figure 2:
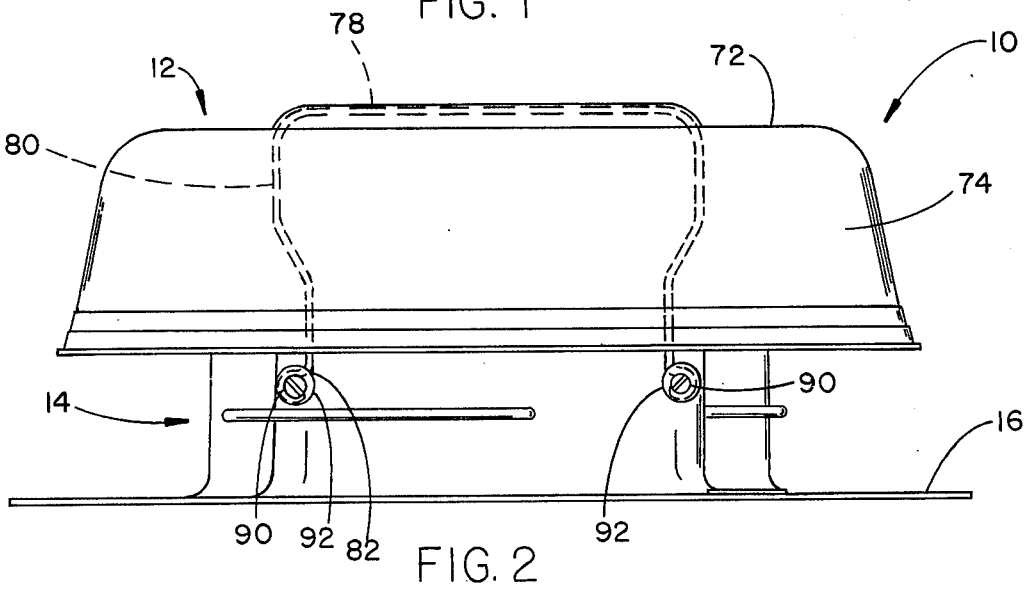
FIG. 2 is a side, elevational view of the power vent of FIG. 1.
Figure 3:
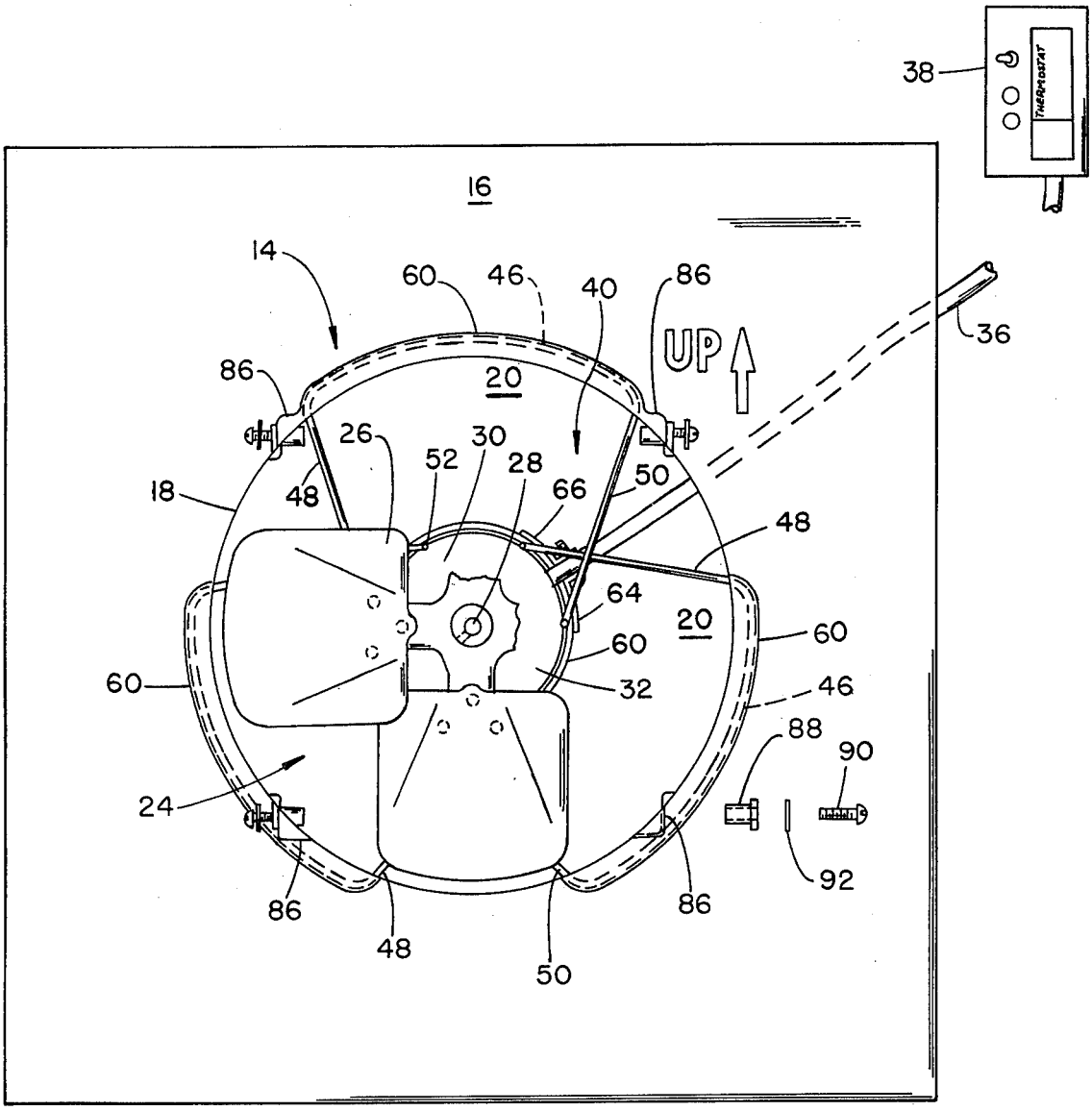
FIG. 3 is a top, plan view of the power vent of FIG. 1 with the hood removed.
Figure 4:
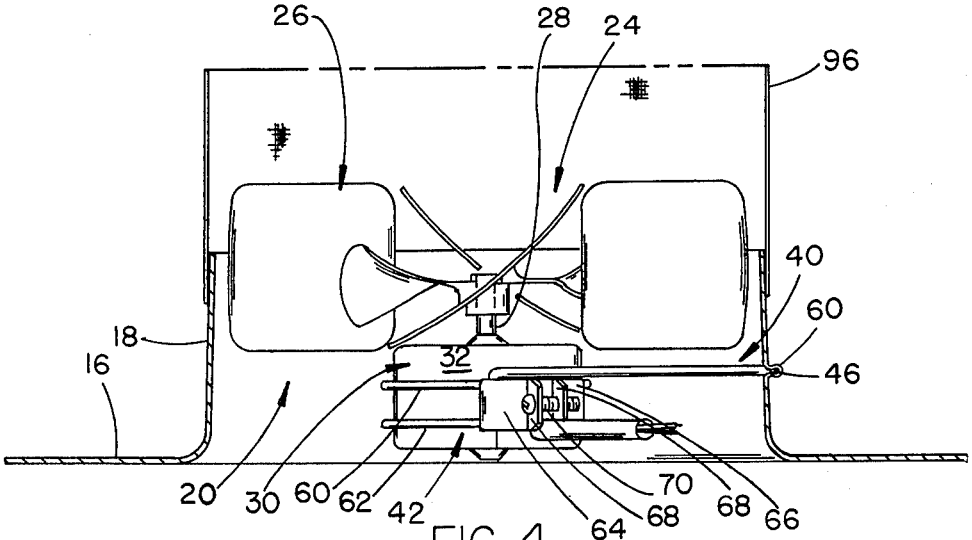
FIG. 4 is a cross-sectional, side elevational view of the power vent of FIG. 1 with the hood removed.

A preferred embodiment of the unique power vent in accordance with the present invention is illustrated in FIGS. 1 and 2 and generally designated 10. The power vent 10, primarily adapted for mounting over an aperture formed in the roof of a building, includes a hood assembly 12 and a housing or shroud assembly 14 within which is mounted a fan. The housing assembly 14 is preferably fabricated from ABS plastic resin material and includes a mounting flange or base 16 having a central aperture formed therein at which is positioned a tubular, open ended member or shroud 18. The shroud 18 and the base 16 define an air duct 20. This is best seen in FIGS. 3 and 4. The shroud 18 is formed integral with the base 16 and the base or mounting flange 16 extends radially outwardly from and around the periphery of one end of the shroud 18.

Supported within the shroud and hence the air duct 20 is a fan assembly 24. The fan assembly 24 includes a fan blade 26 secured to the output shaft 28 of an electric motor 30. The motor 30 preferably includes a generally cylindrical, vented enclosure or housing 32. The motor 30 is connected to a suitable source of electrical power by an enclosed cable 36 through a thermostat control 38 in a conventional manner. The thermostat control 38 controls the operation of the electric motor as a function of temperature to set the upper and lower turn-on, turn-off temperatures at which the motor is activated. In the alternative, the thermostatic control 38 may also be coupled with a humidity control (not shown) which would activate the motor depending upon the humidity levels within the ventilated space.

As best seen in FIGS. 3 and 4, the motor is supported and the shroud portion 18 of the housing is reinforced by a frame means generally designated 40. The motor housing 32 is secured to the frame means by a wire band clamp 42, as more fully described below.

Figure 6:
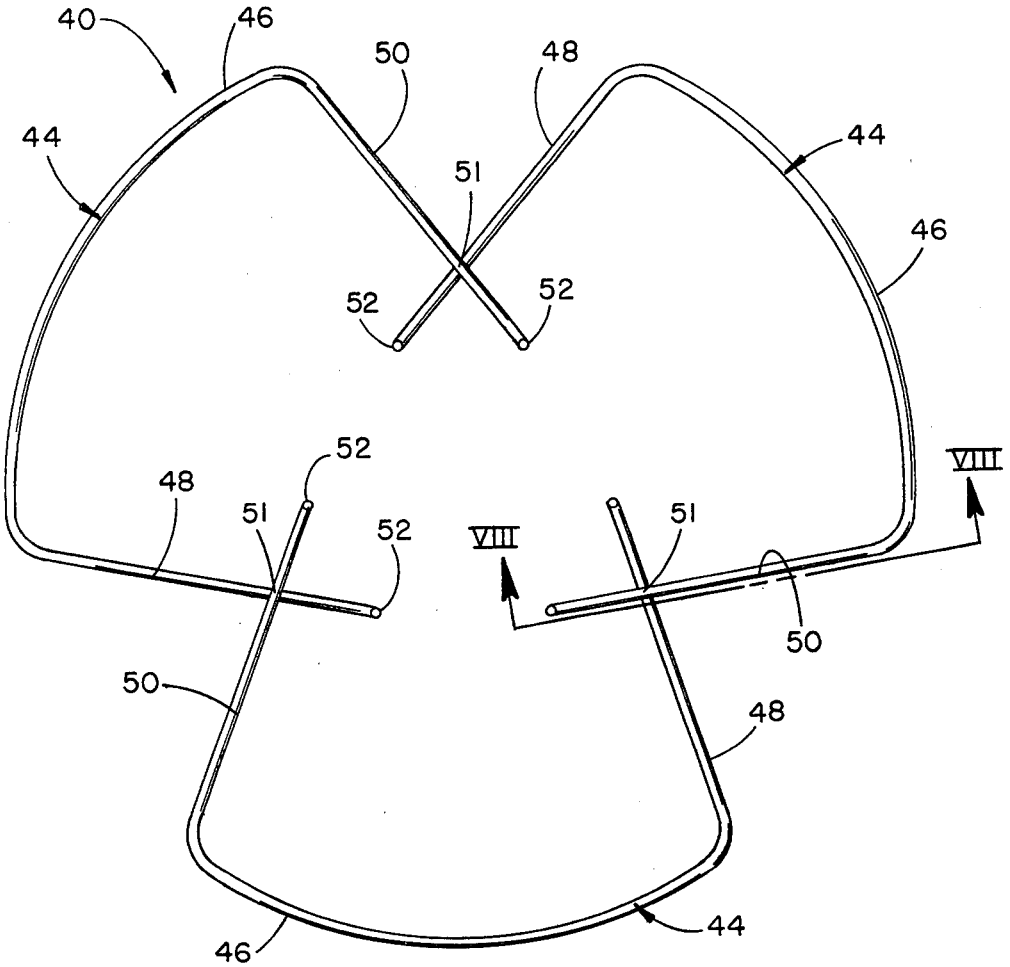
FIG. 6 is a top, plan view of the wire frame incorporated in the present invention.
Figure 8:
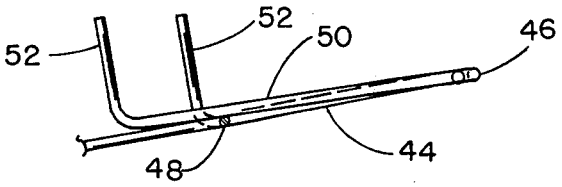
FIG. 8 is a cross-sectional view taken generally along line VIII—VIII of FIG. 6.
Figure 7:
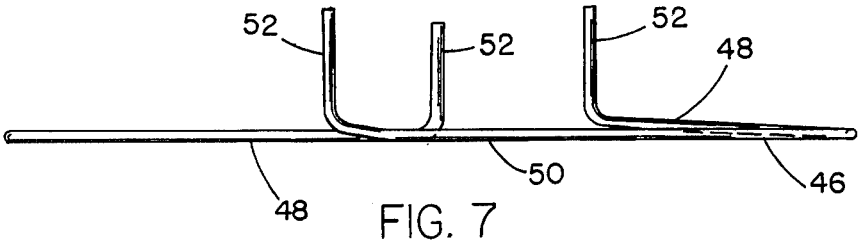
FIG. 7 is a right side elevational view of the frame of FIG. 6.

As seen in FIGS. 6, 7 and 8, the frame means 40 is made up of a plurality of separate single piece, wire members 44. Each wire piece 44 includes a base or reinforcing portion 46 and a pair of integral, converging leg portions 48, 50. The base portions 46 are arcuate in nature and have a radius of curvature corresponding generally to the radius of curvature of the tubular open ended member 18.

Each of the wire members 44 is positioned during assembly so that they open towards a central point and extend radially, outwardly therefrom at equally spaced angles. In the preferred form, three such wire members 44 are employed which extend outwardly at 120° intervals. Each of the legs 50 of adjacent wire members 44 extend over or cross over an adjacent leg 48 of the adjacent wire member in a spoke-like fashion, as seen in FIG. 6. The legs are secured together at the cross over point 51 such as by welding so that the three members 44 comprise a unitary frame. As seen in FIGS. 7 and 8, each of the end portions or free ends 52 of the legs 48 and 50 are bent so as to extend perpendicular to the plane within which the legs 48, 50 and the base portion 46 lie. The end portions 52 are all of equal length and extend vertically or perpendicularly so as to define a spider or bracket to which the motor housing 32 may be clamped.

The equally dimensioned frame members 44 are held by the shroud or tubular portion 18 of the housing assembly within wire receiving passages 60 as best seen in FIGS. 3 and 4. The passages 60 extend circumferentially around at spaced intervals and radially outwardly from the shroud 18. In fabricating the housing assembly, the wire frame 40 is positioned within the mold and the housing is molded directly onto the reinforcing portions or base portions 46 of the wire frame 40. In this fashion, the frame is securely held by the housing assembly 14, is molded into the housing assembly and serves to reinforce the tubular member or shroud 18. The frame therefor increases the rigidity of the plastic material employed. This feature provides a strong, durable structure capable of withstanding the loads enforced upon it in use. The amount of wire necessary to reinforce the structure and provide a motor mount is reduced substantially and a very easily manufactured structure results. After molding, the reinforcing portions 46 of the frame are securely held by the wall of the tubular member 18. The passages 60 are circular in section and surround or enclose the portions 46 of the frame.

As is apparent from FIGS. 3 and 4, the frame 40 and the individual pieces 44 making up the frame are dimensioned so that the upstanding bracket or motor mount portions 52 which extend parallel to the longitudinal centerline of the shroud will engage the outer surface of the housing 32 of the motor. The legs 48, 50 extend radially inwardly towards the center of the shroud or air duct 20. The wire band clamp 42 includes a pair of generally circular wires or clamp members 60, 62 positioned in spaced, parallel relationship to each other. A metal piece 64 is secured as by welding to one end of each of the wires or clamp members 60, 62. Another metal, generally L-shaped member 66 is secured to the other end of each of the wires 60, 62. The metal members 64, 66 include upstanding or outwardly extending tabs 68 each having an aperture formed therein through which is headed fastener or bolt 70 extends. The aperture formed in the upstanding portion 68 of member 66 may be threaded or a nut may be attached to the bolt 70 so that the wire bands 60, 62 may be clamped around legs 52 to thereby secure the housing 30 centrally within the duct 20 defined by the tubular member 18. In the roof vent of FIGS. 1–4, the frame 40 is positioned within the member 18 so the legs 52 all extend towards the flanged end of the member 18.

Figure 5:
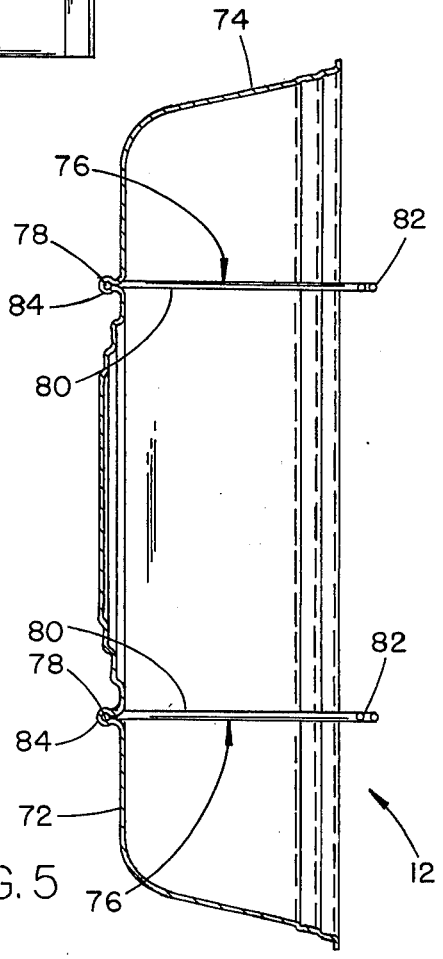
FIG. 5 is a side, elevational view in section of the hood assembly.

The hood assembly 12 is also fabricated from a plastic material and includes a top surface 72 and a depending skirt or side surfaces 74. As seen in FIGS. 2 and 5, a pair of wire support brackets 76 are provided to secure the hood to the tubular member 18. Each wire support bracket 76 has a generally U-shaped configuration and includes a base 78 and depending legs 80. The ends of the depending legs 80 terminate in opposed, inwardly openings hooks 82. The brackets 76 are attached to the tubular member 18 at the hooks 82. In fabricating the molded plastic hood 12, it is preferred that the base portions 78 of the brackets 76 be molded into the top surface 72 of the hood. As seen in FIG. 5, the top surface of the hood will then define wire receiving passages 84 which surround and hold the supports 76 in place so that they extend generally vertically or perpendicularly downwardly from the top surface 72 of the hood 12.

As seen in FIGS. 1 and 3, the tubular member 18 is formed with a plurality of bosses 86. The bosses are provided with a through bore to receive a well nut 88. The well nut includes an internally threaded, rubber mounted bushing which may be threadably engaged by a fastener 90. The well nut 88 is inserted within the boss 86, held by the rubber material and the bolt 90 is passed through a washer 92 and partially threaded into the well nut 88. The hood is then positioned over the top of the air duct and the hooks 82 of the support brackets 76 are received on the bolts 90. The bolts may then be tightened down to firmly secure the hood to the tubular member 18. By employing the rubber mounted bushings of the well nut 88, the hood is resiliently attached and vibration mounted to the housing assembly thereby increasing the stability of the overall construction and reducing the noise levels caused by vibration of the hood during operation of the fan motor. The well nuts are commercially available items.

As seen in FIG. 4, it is preferred that the roof mounted power vent 10 also include a mesh screen 96 extending around the entire periphery of the shroud 18 and upwardly to a point where it engages or touches the undersurface of the top 72 of the hood 12. The mesh screen 96 is provided to prevent entry of insects and the like to the space being ventilated.

In a presently existing embodiment of the power vent illustrated in FIGS. 1–5, the hood is fabricated from an ABS plastic resin such as Monsanto Lustran 452 having a thickness of 0.156 inches. The housing or shroud assembly including the tubular member 18 and the mounting flange 16 is also fabricated from an ABS plastic resin such as Monsanto Lustran 452 and preferably has a sheet thickness of 0.125 inches. The wire frame is preferably fabricated from a steel wire having a diameter of 0.187 inches.

Since the power vent is fabricated from a plastic material which is reinforced by the wire frame means 40, the natural dampening characteristic of the plastic reduces the noise resulting from vibration during the operation of the vent. Further, the hood is vibration mounted to the housing assembly by the well nuts further reducing the incidence of noise. The power vent is relatively easily manufactured and the motor and fan are readily mounted employing the band clamp 42. The roof vent 10 is easily installed at an aperture formed in the roof at a point below the peak line of the roof on the rear slope of the roof. The base or mounting flange 6 is slipped up and under the roof shingles, nailed and all areas are sealed to prevent leakage.

Figure 9:
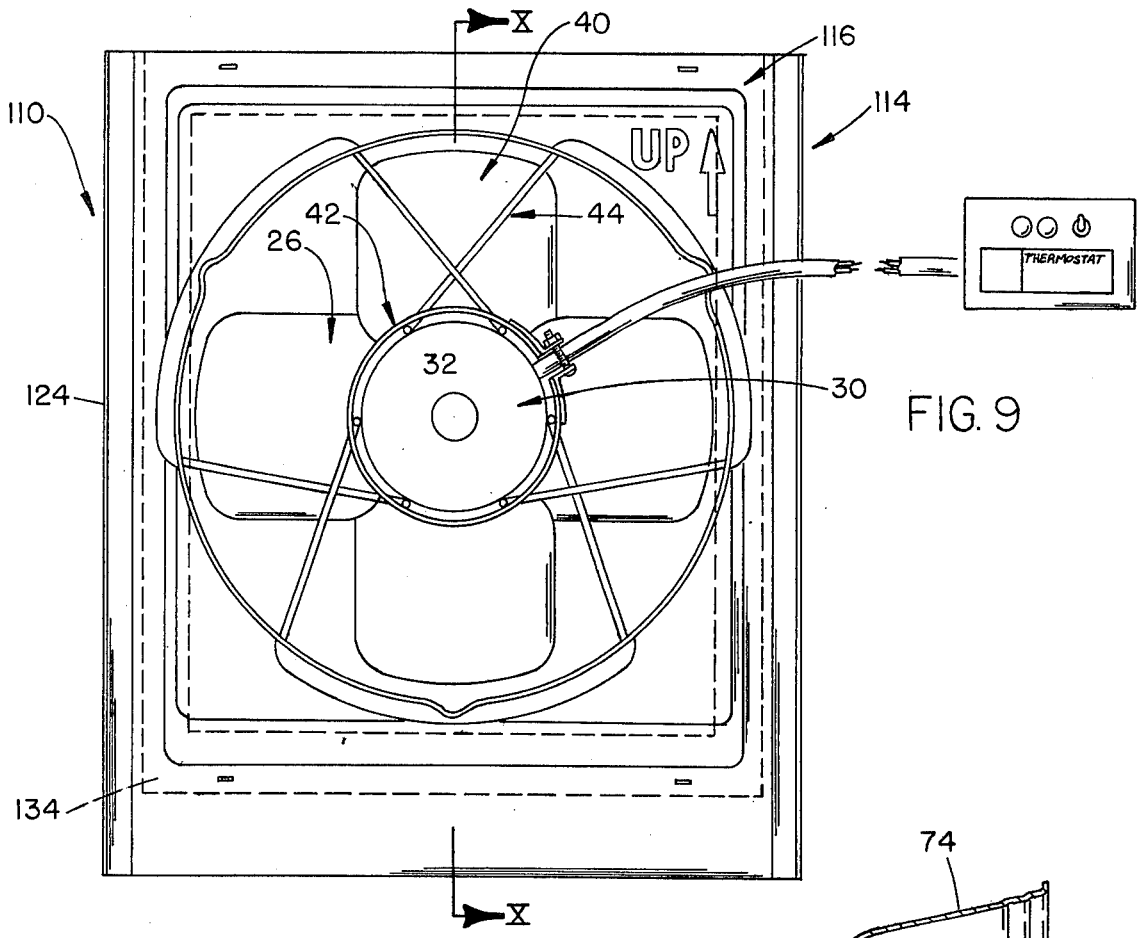
FIG. 9 is a rear elevational view of a power vent adapted for gable end mounting in accordance with the present invention.
Figure 10:
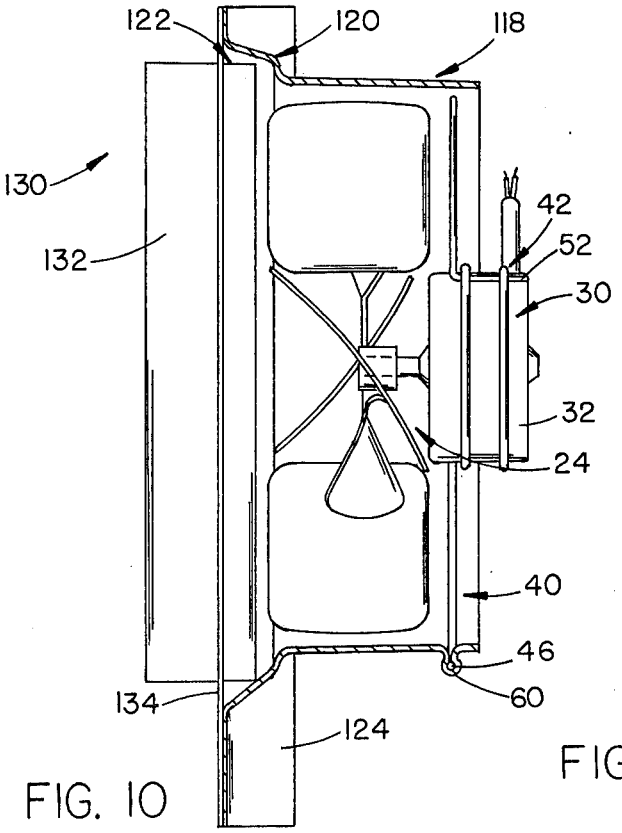
FIG. 10 is a side, partially sectioned, elevational view of the gable end vent of FIG. 9.

Another preferred embodiment of the present invention is illustrated in FIGS. 9 and 10 and generally designated 110. In the following description, like elements are designated by the same numerals employed in the description of the vent of FIGS. 1–5. The power vent 110 is adapted for mounting at a rectangular aperture formed in the gable end of the roof structure of a building. This gable end vent similarly includes a housing or shroud assembly 114. The housing assembly includes a base or mounting flange 116 and a tubular, open ended member or shroud 118. The base 116 has a generally rectangular configuration and includes a portion 120 defining a concave recess or cavity 122 extending towards the member 118. Also, the base 116 is provided with side mounting flanges 124 extending along the lateral edges of the base 116 and generally perpendicular to the base. The flanges 124 provide a means for attaching the assembly to studs positioned within the ventilated space at the opening cut into the gable. The shroud portion 118 also defines an air duct 20 within which is supported the fan assembly 24 including the motor 30 having a cylindrical housing 32. The wire frame 40 of the embodiment illustrated in FIGS. 1–5 is also employed to support the motor 30 and to reinforce the shroud or tubular member 118. The housing 114 is fabricated in the same manner from an ABS plastic resin with the reinforcing portions 46 of the frame molded into the wall of the shroud 118 which defines a plurality of reinforcing wire receiving passages 60. The legs 52 defining the motor mount bracket extend away from the base 116.

The base is recessed at 122 to receive a louver assembly 130. The louver assembly is of a conventional form and includes a rectangular frame 132 between the sidewalls of which are pivotally supported a plurality of louvers or blades. The basic louver assembly 130 is modified, however, to include an outwardly extending mounting flange 134. The mounting flange extends around the entire periphery of the frame. The louver assembly is secured to the base 116 by securing as by stapling the mounting flange 134 to the base 116 at spaced points, as seen in FIG. 9. The louver frame 132 is then received within the cavity or recess 122 defined by the portion 120 of the base. In this manner, all of the air moved by the fan will pass through the louvers and none will be blown back into the ventilated space. Typically, with prior gable installations, the louver is mounted at the outside at the opening cut in the sheeting and the fan or power vent is mounted behind. The mounting flanges employed with such prior vents do not totally enclose the area behind the louver assembly. As a result, air can blow back into the house when the fan is activated to open up the louvers.

However, with the embodiment illustrated in FIGS. 9 and 10, since the mounting flange 134 effectively seals the louver assembly around and at the opening formed in the base 116, the air moved by the fan which opens the louvers also prevents blow back of outside air through the louvers and into the attic.

As with the previously described embodiment, it is preferred that the housing or shroud assembly 114 be fabricated from an ABS plastic resin. It is presently preferred that this portion of the gable end, power vent be fabricated from a 0.1875 inch ABS plastic UL test UL 94, ASTM test D 635 material.

As should now be readily apparent, the power vent in accordance with the present invention whether of the roof type or the gable type is easily manufactured through simple molding processes. The frame structure defines wire reinforcing portions and also defines a motor mount bracket. Employment of the simple band clamp in conjunction with the frame provides easy assembly of the fan and motor assembly to the power vent. Further, employment of a plastic resin material reduces the noise incident to operation when compared with sheet metal power vents.

Undoubtedly, various modifications could be made to the presently preferred embodiments which would not depart from the inventive concepts disclosed herein. For example, the shape of the base or mounting flange, the shape of the tubular member and the shape of the frame could be varied from that illustrated. It is preferred, however, that the tubular member be circular in cross section or cylindrical in shape to provide the most efficient flow of air by the fan assembly. It is expressly intended, therefore, that the above description should be considered as that of the preferred embodiments only. The true spirit and scope of the present invention will be determined by reference to the appended claims.

The embodiments of the invention in which an exclusive property or privilege is claimed are defined as follows:

1. A power vent comprising:

a base having an aperture therein;

an open ended shroud joined to said base at said aperture, said shroud defining a plurality of integral circumferentially and radially extending wire receiving passages a part of said shroud and spaced around the periphery thereof, said passages collectively extending a substantial circumferential distance around said shroud;

fan means for moving air through said shroud;

wire means carried by said shroud and including portions enclosed within and surrounded by said wire receiving passages for reinforcing the shroud and for defining a fan mount; and means for securing said fan means to said fan mount.

2. A power vent as defined by claim 1 wherein each of said wire means comprises:

a plurality of single length bent wires, each of said wires defining a base portion disposed within one of said wire receiving passages and a pair of legs extending radially inwardly towards the center of said shroud.

3. A power vent comprising:
a base having an aperture therein;
an open ended shroud joined to said base at said aperture, said shroud defining a plurality of circumferentially and radially extending wire receiving passages spaced around the periphery thereof;
fan means for moving air through said shroud;
wire means carried by said shroud and including portions within and surrounded by said wire receiving passages for reinforcing the shroud and for defining a fan mount; and
means for securing said fan means to said fan mount, each of said wire means comprising:
a plurality of single length bent wires, each of said wires defining a base portion disposed within one of said wire receiving passages and a pair of legs extending radially inwardly towards the center of said shroud, the free ends of each of the legs of said wire means being bent at substantially a right angle to thereby define said fan mount.

4. A power vent as defined by claim 3 wherein said fan means includes a generally cylindrical motor housing and wherein said fan securing means comprises:
a band clamp means for clamping each of the free ends of the legs of said wire means against said fan means motor housing.

5. A power vent as defined by claim 3 wherein adjacent legs of adjacent ones of said wire means cross over each other in a spoke-like fashion to define a cross over point, said adjacent legs being joined to each other at the cross over points.

6. A power vent as defined by claim 5 wherein said base and said shroud are integrally molded from plastic and said base portions of said wire means are molded within said wire receiving passages and into said shroud.

7. A power vent as defined by claim 5 further including:
a hood having a generally planar top portion and a depending side portion;
a pair of wire hood supports carried by said top portion; and
a plurality of means for resiliently attaching said hood supports to said shroud.

8. A power vent as defined by claim 7 wherein each of said wire hood supports comprises:
a generally U-shaped wire having a base portion held by said top portion and a pair of spaced legs extending generally perpendicular to said top portion, said legs terminating in hook portions.

9. A power vent as defined by claim 8 wherein each of said means for attaching said hood supports to said shroud comprises:
an internally threaded, rubber mounted bushing, said bushing supported by said shroud; and
a threaded fastener extending through said hook portion of said hood support and threadably engaging said bushing.

10. A power vent as defined by claim 3 wherein said base comprises a generally rectangular member defining a peripherally extending mounting flange and a concave recess extending from said mounting flange towards said shroud.

11. A power vent as defined by claim 10 further including a louver assembly attached to said mounting flange and including a frame, said frame extending into said recess and an outwardly extending louver mounting flange extending around said frame, said louver assembly being attached to said base mounting flange at said louver mounting flange whereby blow back of air into the ventilated space is prevented.

12. A housing assembly for a power vent of the type including a motor driven fan, said housing assembly comprising:
a tubular, open ended member defining an air duct within which said fan may be disposed;
a rigid, wire frame defining a fan motor mounting bracket having portions extending generally parallel to the longitudinal axis of said open ended member and including a plurality of open ended member reinforcing portions; and
means a part of said open ended member extending a substantial circumferential distance around said open ended member for receiving, enclosing and surrounding said reinforcing portions of said frame and supporting said frame within said air duct.

13. A housing assembly as defined by claim 12 wherein said tubular member is formed from plastic material and said receiving means comprises a plurality of wire frame reinforcing portions, receiving passages molded around said wire frame reinforcing portions, said wire frame reinforcing portions being imbedded into said tubular member.

14. A housing assembly for a power vent of the type including a motor driven fan, said housing assembly comprising:
a tubular, open ended member defining an air duct within which said fan may be diposed;
a rigid, wire frame defining a fan motor mounting bracket and including a plurality of open ended member reinforcing portions; and
means a part of said open ended member for receiving said reinforcing portions of said frame and supporting said frame within said air duct, said tubular member being formed from plastic material and said receiving means comprising a plurality of wire frame, reinforcing portion receiving passages formed by molding said wire frame reinforcing portions into said tubular member, said tubular member being cylindrical in shape and said reinforcing portions of said frame being arcuate and conforming to the curvature of the tubular member.

15. A housing assembly as defined by claim 14 wherein said rigid wire frame comprises:
a plurality of generally U-shaped members each including a base defining one of said reinforcing portions and also having converging legs integral with the ends of the base, said U-shaped members positioned to extend radially outwardly from the center of said tubular member and wherein one of the legs of each of said U-shaped members crosses over a leg of the next adjacent member in a spoke-like fashion and is connected to the adjacent member at the point of cross over.

16. A housing assembly as defined by claim 15 wherein the free end of each of said legs of said wire frame extends parallel to the longitudinal centerline of said tubular member to thereby define said fan motor mounting bracket.

17. A housing assembly as defined by claim 16 further including a generally rectangular mounting flange extending radially outwardly from and around the periphery of said tubular member at one end thereof.

18. A housing assembly as defined by claim 16 wherein said mounting flange defines a concave cavity extending towards said tubular member.

19. A housing assembly as defined by claim 18 further including side mounting flanges extending parallel to each other and perpendicular to said rectangular mounting flange along the lateral edges thereof.

* * * * *

UNITED STATES PATENT AND TRADEMARK OFFICE

CERTIFICATE OF CORRECTION

PATENT NO. : 4,123,968

DATED : November 7, 1978

INVENTOR(S) : Richard C. Malott

It is certified that error appears in the above-identified patent and that said Letters Patent are hereby corrected as shown below:

Column 8, line 26:

"diposed" should be --disposed--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*